US012628966B2

(12) United States Patent
Liang

(10) Patent No.: US 12,628,966 B2
(45) Date of Patent: May 19, 2026

(54) FOLDING BABY HIGHCHAIR

(71) Applicant: GUANGZHOU PRODIGY DAILY-PRODUCTION CO., LTD, Guangzhou (CN)

(72) Inventor: Zhanpeng Liang, Guangzhou (CN)

(73) Assignee: GUANGZHOU PRODIGY DAILY-PRODUCTION CO., LTD, Guangzhou (CN)

( * ) Notice: Subject to any disclaimer, the term of this patent is extended or adjusted under 35 U.S.C. 154(b) by 148 days.

(21) Appl. No.: 18/791,486

(22) Filed: Aug. 1, 2024

(65) Prior Publication Data

US 2026/0007252 A1 Jan. 8, 2026

(30) Foreign Application Priority Data

Jul. 2, 2024 (CN) ..... 202421552367.X

(51) Int. Cl.
*A47D 1/02* (2006.01)
*A47D 1/00* (2006.01)

(52) U.S. Cl.
CPC ..... *A47D 1/023* (2017.05); *A47D 1/008* (2013.01); *A47D 1/0085* (2017.05)

(58) Field of Classification Search
CPC ..... A47D 1/023; A47D 1/008; A47D 1/0085
USPC ..... 297/16.1, 35, 40, 378.1, 411.3, 411.44
See application file for complete search history.

(56) References Cited

U.S. PATENT DOCUMENTS 4,603,902 A * 8/1986 Maloney ..... A47D 1/0081 297/39
4,938,603 A * 7/1990 Turner ..... A47D 1/023 297/16.1
7,201,445 B1 * 4/2007 Dubiel ..... A47D 1/103 297/256.13
2024/0324790 A1 * 10/2024 Longenecker ..... A47D 1/004

* cited by examiner

*Primary Examiner* — Robert Canfield

(57) ABSTRACT

A folding baby highchair, comprising a backrest assembly and a cushion, the backrest assembly is foldable towards the cushion to allow the grips to rotate towards the cushion by means of the grip pillars so as to drive the grip pillars to rotate to be stored in the grips, and chair legs are hinged to two inner sides of the cushion, the chair legs can be folded towards the bottom of the cushion, and the tray assembly can be detached and reassembled when necessary, such that the folding baby highchair is simple in structure and reasonable in design; and the components are foldable or detachable, such that the folding baby highchair occupies less space and is easy to carry.

10 Claims, 6 Drawing Sheets

FOLDING BABY HIGHCHAIR

CROSS REFERENCE TO RELATED APPLICATIONS

The present application claims the benefit of Chinese Patent Application No. 202421552367.X filed on Jul. 2, 2024, the contents of which are incorporated herein by reference in their entirety.

TECHNICAL FIELD

The invention belongs to the technical field of folding chairs, and more particularly relates to a folding baby highchair.

DESCRIPTION OF RELATED ART

At present, most children's folding dining chairs are folded by the seat legs, and other parts of the seat cannot be folded. Folding the seat legs still takes up a lot of space, making it inconvenient to use children's dining chairs.

BRIEF SUMMARY OF THE INVENTION

The main objective of the invention is to provide a folding baby highchair which occupies less space and easy to carry.

A folding baby highchair, comprising a backrest assembly and a cushion, wherein one end of the cushion is hinged to a bottom end of the backrest assembly, grip pillars are hinged to two outer sides of the cushion, ends, away from the cushion, of the grip pillars are hinged to middle portions of grips, one end of each grip is hinged to the backrest assembly, a tray assembly is detachably mounted on the other end of each grip, the backrest assembly is foldable towards the cushion to allow the grips to rotate towards the cushion by means of the grip pillars so as to drive the grip pillars to rotate to be stored in the grips, and chair legs are hinged to two inner sides of the cushion.

A folding baby highchair, the backrest assembly comprises a backrest body and a backrest cover, the backrest cover and the backrest body are fixedly connected by means of bolts, and a first connecting portion hinged to the backrest body is arranged on the cushion and hinged to a bottom end of the backrest body by means of backrest spindles.

A folding baby highchair, a backrest switch chamber defined by a plurality of first fixing plates is arranged on the backrest body, the first fixing plates are fixedly arranged on the backrest body, a backrest switch is movably arranged in the backrest switch chamber, first abutting plates are fixedly arranged in the backrest switch chamber, the backrest switch abuts against the first abutting plates by means of first elastic elements, a first groove matched with the backrest switch is formed in the first connecting portion, the backrest switch is slidably inserted into the first groove, and the backrest switch can be manually pulled upward to allow an insertion end of the backrest switch to be away from the first groove in the backrest body.

A folding baby highchair, grip assembly holes are formed in ends, close to the backrest assembly, of the grips, second connecting portions are symmetrically arranged on two sides of the backrest assembly, the second connecting portions are located on two sides of the backrest body of the backrest assembly and inserted into the grip assembly holes, and one end of each grip is rotatably connected to the backrest assembly.

A folding baby highchair, first connecting holes are formed in two sides of the middle portions of the grips, second connecting holes matched with the first connecting holes are formed in ends, close to the grips, of the grip pillars, the grip pillars and the grips are rotatably connected by means of first bolts, the first bolts penetrate through the first connecting holes and the second connecting holes, receiving spaces for receiving the grip pillars are formed in the grips, and the grip pillars can rotate to be received in the receiving spaces; the second connecting holes of the grip pillars are aligned with the first connecting holes, and then the first bolts penetrate through the first connecting holes and the second connecting holes, such that the grips and the grip pillars can rotate relatively.

A folding baby highchair, ends close to the tray assembly, of the grips are sleeved with tray connectors, the tray connectors are arranged detachably, one end of each tray connector is inserted into the corresponding grip, and the other end of each tray connector is clamped on the tray assembly.

A folding baby highchair, first spaces allowing the grips to be inserted therein are formed in the tray connectors, first switch chambers are arranged at bottoms of the tray connectors, tray connector switches for locking together the tray connectors and the grips are movably arranged in the first switch chambers, the tray connector switches abut against the first switch chambers by means of second elastic elements, the first switch chambers and first switch chamber covers are clamped together, and the tray connector switches are exposed out of the first switch chamber covers.

A folding baby highchair, the tray assembly comprises a tray body and a tray base, clamping grooves are formed in two sides of the tray base, clamping blocks matched with the clamping grooves are arranged on two sides of the tray body, the clamping blocks can be clamped in the clamping grooves to clamp together the tray assembly and the tray base, tray switch locks are arranged on two sides of the bottom of the tray base, the tray base and the tray connectors are connected by means of the tray switch locks, and the tray switch locks are clamped to the tray connectors by means of third elastic elements.

A folding baby highchair, chair leg switch locks are arranged on inner side of the chair legs and abut against the bottom of the cushion by means of fourth elastic elements, one end of each chair leg switch lock is clamped to the bottom of the cushion, two sides of each chair leg are hinged to the cushion by means of spindles, the chair legs can be folded towards the bottom of the cushion, and anti-slip pads are arranged at the bottoms of the chair legs.

A folding baby highchair, a plurality of straps are connected to the backrest assembly and the cushion.

One of the above-mentioned technical solutions of the invention has at least one of the following advantages or beneficial effects:

The backrest assembly of the folding baby highchair can be folded towards the cushion, the grips are hinged to two sides of the backrest assembly and thus can rotate towards the cushion, the grip pillars can be rotated to be stored and hidden in the grips, the chair legs can be folded towards the bottom of the cushion, and the tray assembly can be detached and reassembled when necessary, such that the folding baby highchair is simple in structure and reasonable in design; and the components are foldable or detachable, such that the folding baby highchair occupies less space and is easy to carry.

BRIEF DESCRIPTION OF THE SEVERAL VIEWS OF DRAWINGS

The invention is further described below in conjunction with accompanying drawings and embodiments.

DETAILED DESCRIPTION OF THE INVENTION

Different embodiments or examples are provided below to implement different solutions of the invention.

Figure 1:
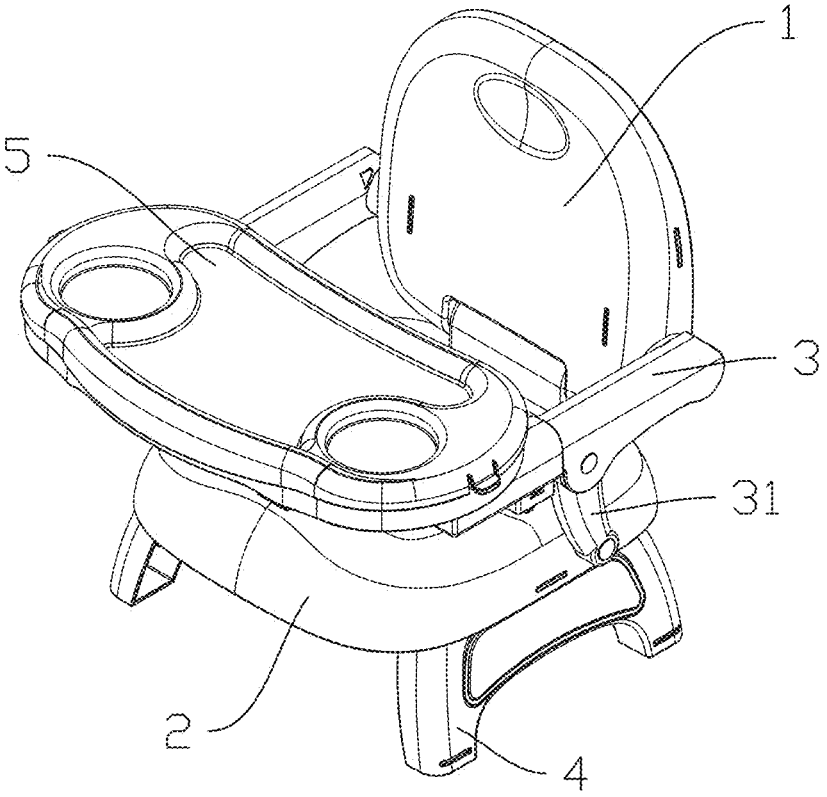
FIG. 1 is a schematic structural view of a folding baby highchair according to one embodiment of the invention.
Figure 2:
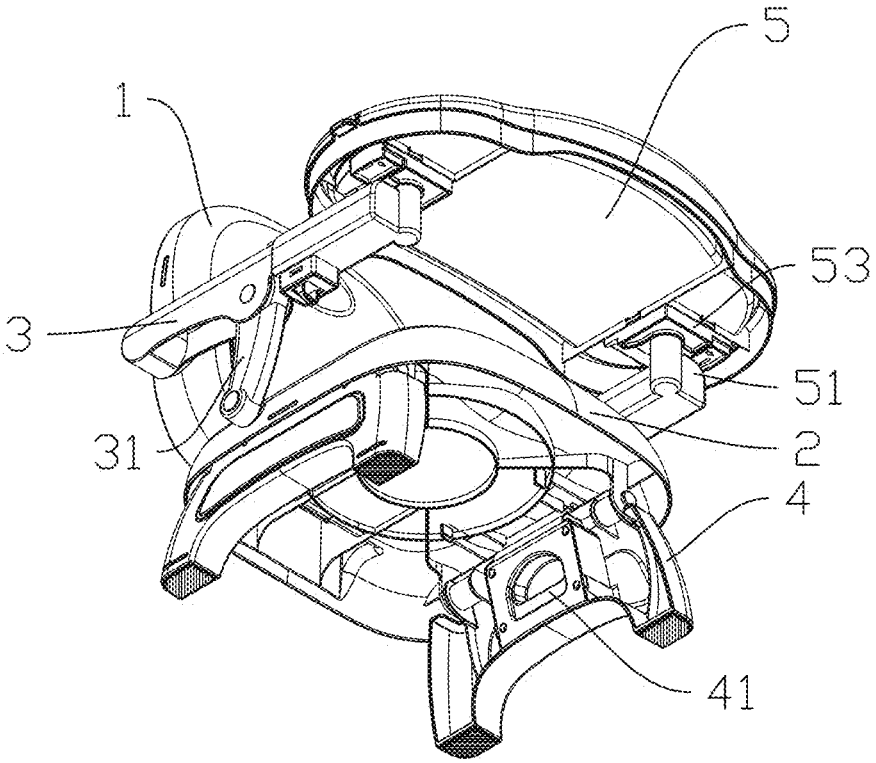
FIG. 2 is a schematic structural view from another perspective of the folding baby highchair according to one embodiment of the invention.
Figure 3:
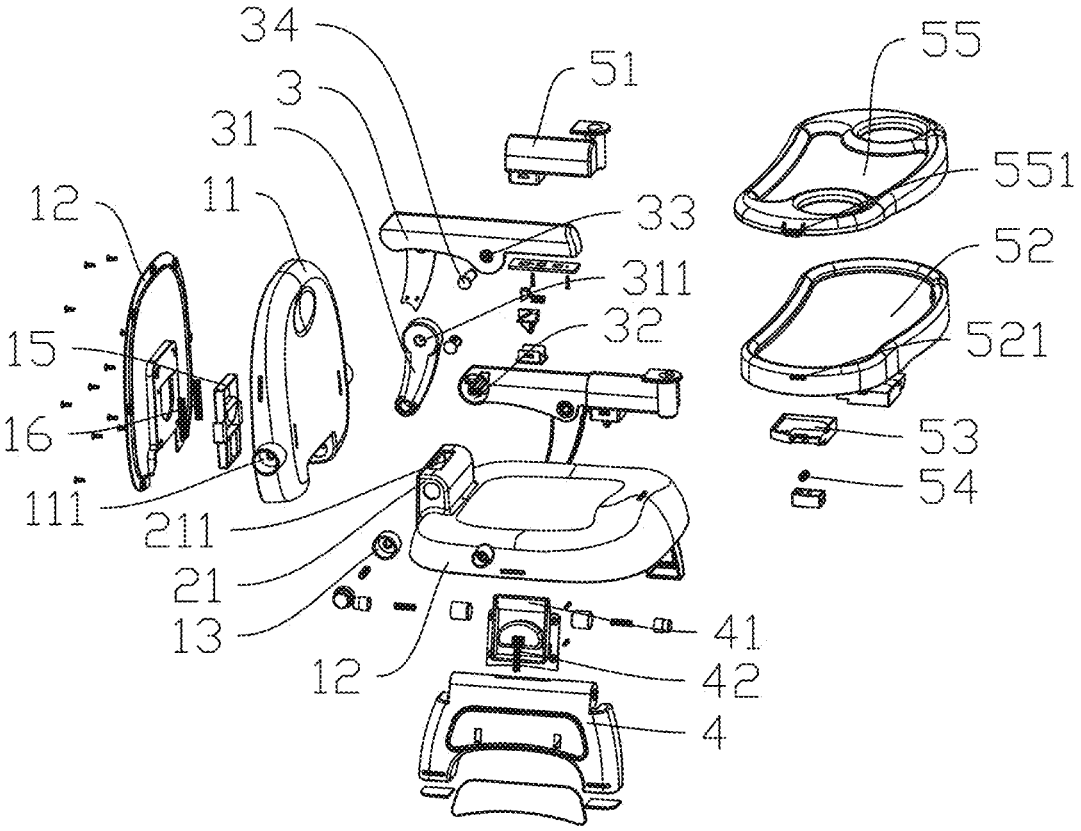
FIG. 3 is an exploded structural view of the folding baby highchair according to one embodiment of the invention.
Figure 4:
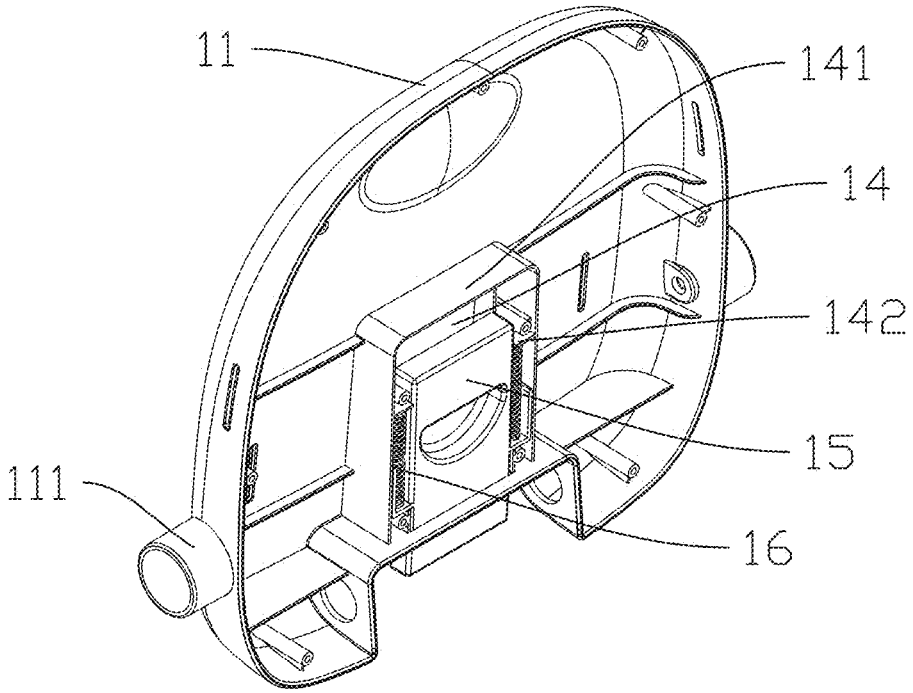
FIG. 4 is a schematic structural view of a backrest assembly without a backrest cover according to one embodiment of the invention.
Figure 5:
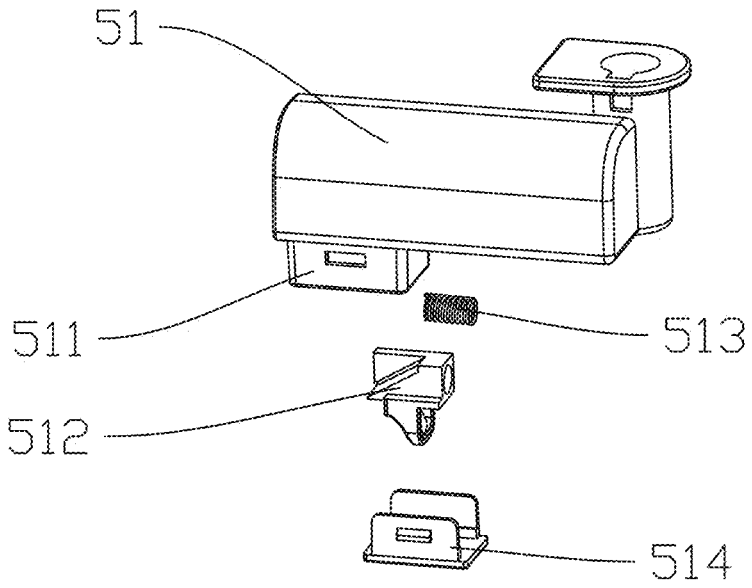
FIG. 5 is a schematic structural view of a tray connector according to one embodiment of the invention.
Figure 6:
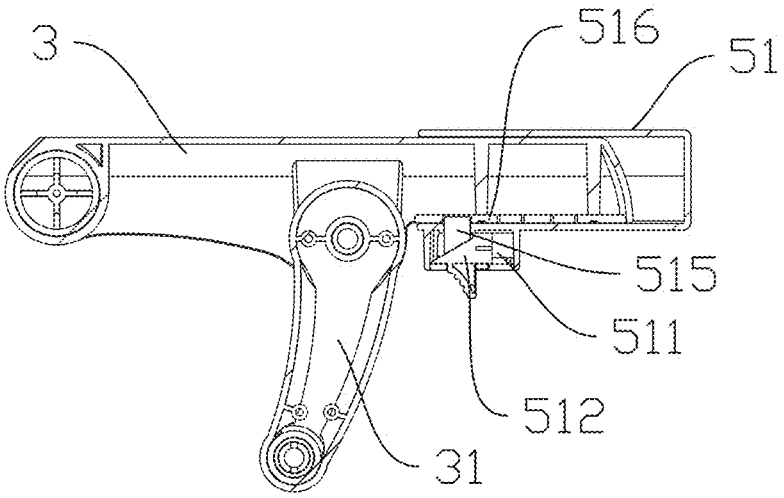
FIG. 6 is a sectional view of a grip, a grip pillar and a tray connector which are assembled together according to one embodiment of the invention.

Referring to FIG. 1 to FIG. 6, the invention provides a folding baby highchair, comprising a backrest assembly 1 and a cushion 2, wherein one end of the cushion 2 is hinged to a bottom end of the backrest assembly 1, grip pillars 31 are hinged to two outer sides of the cushion 2, ends, away from the cushion 2, of the grip pillars 31 are hinged to middle portions of grips 3, one end of each grip 3 is hinged to the backrest assembly 1, a tray assembly 5 is detachably mounted on the other end of each grip 3, the backrest assembly 1 is foldable towards the cushion 2 to allow the grips 3 to rotate towards the cushion 2 by means of the grip pillars 31 so as to drive the grip pillars 31 to rotate to be stored in the grips 3, and chair legs 4 are hinged to two inner sides of the cushion 2.

In this embodiment, the backrest assembly 1 can be folded towards the cushion 2, and in the folding process of the backrest assembly 1, the grips 3 rotate towards the cushion 2 to allow the grip pillars 31 to gradually rotate into the grips 3 and finally hidden and stored in the grips 3, the tray assembly 5 can be detached to be carried easily and can also be reassembled when necessary, the two chair legs 4 can be rotated and folded towards each other and towards the cushion 2 to fold the baby highchair, and the components can be unfolded or reassembled when the baby highchair is used. In this way, the baby highchair occupies less space and is easy to carry.

In one embodiment of the invention, the backrest assembly 1 comprises a backrest body 11 and a backrest cover 12, the backrest cover 12 and the backrest body 11 are fixedly connected by means of bolts, and a first connecting portion 21 hinged to the backrest body 11 is arranged on the cushion 2 and hinged to a bottom end of the backrest body 11 by means of backrest spindles 13.

The backrest spindles 13 are mounted on two sides of the first connecting portion 21 and rotatably connected to the bottom end of the backrest body 11, backrest through-holes matched with the backrest spindles 13 are formed in the bottom end of the backrest body 11, and the backrest spindles 13 are inserted into the backrest through-holes to allow the backrest body 11 to rotate towards the cushion 2.

Further, a backrest switch chamber 14 defined by a plurality of first fixing plates 141 is arranged on the backrest body 11, the first fixing plates 141 are fixedly arranged on the backrest body 11, a backrest switch 15 is movably arranged in the backrest switch chamber 14, first abutting plates 142 are fixedly arranged in the backrest switch chamber 14, the backrest switch 15 abuts against the first abutting plates 142 by means of first elastic elements 16, a first groove 211 matched with the backrest switch 15 is formed in the first connecting portion 21, the backrest switch 15 is slidably inserted into the first groove 211, and the backrest switch 15 can be manually pulled upward to allow an insertion end of the backrest switch 15 to be away from the first groove 211 in the backrest body 11.

At this moment, the backrest body 11 can be rotated. When the highchair needs to be used, the backrest switch 15 is manually pulled upward and is released after being rotated to a suitable position, and under the action of the first elastic elements 16, the insert end of the backrest switch 15 is automatically inserted into the first groove 211 in backrest body 11, such that the backrest body 11 is fixed and will not rotate in use.

In one embodiment of the invention, grip assembly holes 32 are formed in ends, close to the backrest assembly 1, of the grips 3, second connecting portions 111 are symmetrically arranged on two sides of the backrest assembly 1, the second connecting portions 111 are located on two sides of the backrest body 11 of the backrest assembly 1 and inserted into the grip assembly holes 32, and one end of each grip 3 is rotatably connected to the backrest assembly 1.

The second connecting portions 111 on the backrest body 11 are assembled in the grip assembly holes 32 in the grips 3, and after the second connecting portions 111 are assembled in the grip assembly holes 32, the grips 3 can rotate freely.

Further, first connecting holes 33 are formed in two sides of the middle portions of the grips 3, second connecting holes 311 matched with the first connecting holes 33 are formed in ends, close to the grips 3, of the grip pillars 31, the grip pillars 31 and the grips 3 are rotatably connected by means of first bolts 34, the first bolts 34 penetrate through the first connecting holes 33 and the second connecting holes 311, receiving spaces for receiving the grip pillars 31 are formed in the grips 3, and the grip pillars 31 can rotate to be received in the receiving spaces; the second connecting holes 311 of the grip pillars 31 are aligned with the first connecting holes 31, and then the first bolts 34 penetrate through the first connecting holes 33 and the second connecting holes 311, such that the grips 3 and the grip pillars 31 can rotate relatively; because one end of each grip 3 is rotatably connected to the corresponding second connecting portion 111, when the backrest assembly 1 is folded towards the cushion 2, the grip pillars 31 will be folded in the receiving spaces of the grips 2 to be stored and hidden; and cushion connectors connected to the grip pillars 31 are arranged on the cushion 2, grip pillar connecting holes are formed in ends, close to the cushion 2, of the grip pillars 31, the cushion connectors are assembled in the grip pillar connecting holes, and after the cushion connectors are assembled in the grip pillar connecting holes, the grip pillars 31 can rotate around the cushion connectors.

In one embodiment of the invention, ends close to the tray assembly 5, of the grips 3 are sleeved with tray connectors 51, the tray connectors 51 are arranged detachably, one end of each tray connector 51 is inserted into the corresponding grip 3, and the other end of each tray connector 51 is clamped on the tray assembly 5.

In one embodiment of the invention, first spaces allowing the grips 3 to be inserted therein are formed in the tray connectors 51, first switch chambers 511 are arranged at bottoms of the tray connectors 51, tray connector switches 512 for locking together the tray connectors 51 and the grips 3 are movably arranged in the first switch chambers 511, the tray connector switches 512 abut against the first switch chambers 511 by means of second elastic elements 513, the first switch chambers 511 and first switch chamber covers 514 are clamped together, and the tray connector switches 512 are exposed out of the first switch chamber covers 514.

The first switch chambers 511 are connected to the first spaces, the tray connector switches 512 are pressed to insert the grips 3 into the first spaces of the tray connectors 51, then the tray connector switches 512 are released, and under the action of the elastic force of the second elastic elements 513, the tray connector switches 512 return to the original positions; because one end of each grip 3 is clamped and locked to the corresponding tray connector 51, when the tray connector switches 512 are pressed again, the tray connectors 51 will be disconnected from the grips 3, and at this moment, the tray connectors 51 can slide outwards to be taken out. Preferably, to allows users to easily adjust the distance between the tray assembly 5 and the backrest assembly 1, tray connector switch buckles 515 are arranged on the tray connector switches 512, adjusting plates 516 are fixed to bottoms of the ends, connected to the tray connectors 51, of the grips 3, and a plurality of square holes matched with the tray connector switch buckles 515 are formed in the adjusting plates 516; when the tray connector switches 512 are pressed to drive the tray connector switch buckles 4515 to be away from the square holes in the adjusting plates 516, the tray assembly 5 can be pulled to adjust the distance between the tray assembly 5 and the backrest assembly 1; and after the distance between the tray assembly 5 and the backrest assembly 1 is adjusted, the tray connector switches 512 are released, and then the positions of the tray connectors 51 are slightly adjusted to allow the tray connector switch buckles 515 to be clamped and fixed in the square holes in the adjusting plate 516 again.

In one embodiment of the invention, the tray assembly 5 comprises a tray body 55 and a tray base 52, clamping grooves 521 are formed in two sides of the tray base 52, clamping blocks 551 matched with the clamping grooves 521 are arranged on two sides of the tray body 55, the clamping blocks 551 can be clamped in the clamping grooves 521 to clamp together the tray assembly 55 and the tray base 52, tray switch locks 53 are arranged on two sides of the bottom of the tray base 52, the tray base 52 and the tray connectors 51 are connected by means of the tray switch locks 53, and the tray switch locks 53 are clamped to the tray connectors 52 by means of third elastic elements.

Each tray switch lock 53 comprises a tray switch lock body, a third elastic element 54 and a tray switch lock button, the tray switch lock bodies are clamped to the tray base 52, first clamping grooves are formed in ends, connected to the tray assembly 5, of the tray connectors 51, and the tray switch lock buttons are clamped in the first clamping grooves and abut against the tray switch lock bodies by means of the third elastic elements 54. In this way, the tray switch lock buttons can be pulled outwards to be away from the first clamping grooves, the tray assembly 5 can be detached. When the tray assembly 5 needs to be reassembled, the tray switch lock buttons are pulled outwards and are released when the tray assembly 5 is assembled in position, and under the action of the third elastic elements 54, the tray switch lock buttons are clamped in the first clamping grooves to be clamped and fixed to the tray connectors 51.

In one embodiment of the invention, chair leg switch locks 41 are arranged on inner side of the chair legs 4 and abut against the bottom of the cushion 2 by means of fourth elastic elements 42, one end of each chair leg switch lock 41 is clamped to the bottom of the cushion 2, two sides of each chair leg 4 are hinged to the cushion 2 by means of spindles, the chair legs 4 can be folded towards the bottom of the cushion 2, and anti-slip pads are arranged at the bottoms of the chair legs 4.

When the chair leg switch locks 41 are pulled downwards, clamping ends of the chair leg switch locks 41 will be driven to be away from the bottom end of the cushion 2, and at this moment, the chair legs 4 can rotate to be folded towards the bottom of the cushion 2, such that the highchair is folded. When the highchair needs to be used, the chair leg switch locks 41 are pulled downwards; after the chair legs 4 are completely unfolded, the chair leg switch locks 41 are released; and under the action of the fourth elastic elements 42, the clamping ends of the chair leg switch locks 41 are clamped and fixed to the bottom of the cushion 2 again.

Preferably, a plurality of straps are connected to the backrest assembly 1 and the cushion 2.

Holes are formed in a front end of a front side of the cushion 2 and a front side of the backrest body 11, and the holes can be used together with the straps to fasten a child in use; and holes in edges of two sides of the backrest body 11 are used for fasten the backrest assembly 2 to the back of an adult chair. By means of the straps, the baby highchair can be used in various scenarios.

What is claimed is:

1. A folding baby highchair, comprising a backrest assembly and a cushion, wherein one end of the cushion is hinged to a bottom end of the backrest assembly, grip pillars are hinged to two outer sides of the cushion, ends, away from the cushion, of the grip pillars are hinged to middle portions of grips, one end of each grip is hinged to the backrest assembly, a tray assembly is detachably mounted on the other end of each grip, the backrest assembly is foldable towards the cushion to allow the grips to rotate towards the cushion by means of the grip pillars so as to drive the grip pillars to rotate to be stored in the grips, and chair legs are hinged to two inner sides of the cushion.

2. The folding baby highchair according to claim 1, wherein the backrest assembly comprises a backrest body and a backrest cover, the backrest cover and the backrest body are fixedly connected by means of bolts, and a first connecting portion hinged to the backrest body is arranged on the cushion and hinged to a bottom end of the backrest body by means of backrest spindles.

3. The folding baby highchair according to claim 2, wherein a backrest switch chamber defined by a plurality of first fixing plates is arranged on the backrest body, the first fixing plates are fixedly arranged on the backrest body, a backrest switch is movably arranged in the backrest switch chamber, first abutting plates are fixedly arranged in the backrest switch chamber, the backrest switch abuts against the first abutting plates by means of first elastic elements, a first groove matched with the backrest switch is formed in the first connecting portion, the backrest switch is slidably inserted into the first groove, and the backrest switch can be manually pulled upward to allow an insertion end of the backrest switch to be away from the first groove in the backrest body.

4. The folding baby highchair according to claim 1, wherein grip assembly holes are formed in ends, close to the backrest assembly, of the grips, second connecting portions are symmetrically arranged on two sides of the backrest assembly, the second connecting portions are located on two sides of the backrest body of the backrest assembly and inserted into the grip assembly holes, and one end of each grip is rotatably connected to the backrest assembly.

5. The folding baby highchair according to claim 1, wherein first connecting holes are formed in two sides of the middle portions of the grips, second connecting holes matched with the first connecting holes are formed in ends, close to the grips, of the grip pillars, the grip pillars and the grips are rotatably connected by means of first bolts, the first bolts penetrate through the first connecting holes and the second connecting holes, receiving spaces for receiving the grip pillars are formed in the grips, and the grip pillars can rotate to be received in the receiving spaces; the second connecting holes of the grip pillars are aligned with the first connecting holes, and then the first bolts penetrate through the first connecting holes and the second connecting holes, such that the grips and the grip pillars can rotate relatively.

6. The folding baby highchair according to claim 1, wherein ends close to the tray assembly, of the grips are sleeved with tray connectors, the tray connectors are arranged detachably, one end of each tray connector is inserted into the corresponding grip, and the other end of each tray connector is clamped on the tray assembly.

7. The folding baby highchair according to claim 6, wherein first spaces allowing the grips to be inserted therein are formed in the tray connectors, first switch chambers are arranged at bottoms of the tray connectors, tray connector switches for locking together the tray connectors and the grips are movably arranged in the first switch chambers, the tray connector switches abut against the first switch chambers by means of second elastic elements, the first switch chambers and first switch chamber covers are clamped together, and the tray connector switches are exposed out of the first switch chamber covers.

8. The folding baby highchair according to claim 6, wherein the tray assembly comprises a tray body and a tray base, clamping grooves are formed in two sides of the tray base, clamping blocks matched with the clamping grooves are arranged on two sides of the tray body, the clamping blocks can be clamped in the clamping grooves to clamp together the tray assembly and the tray base, tray switch locks are arranged on two sides of the bottom of the tray base, the tray base and the tray connectors are connected by means of the tray switch locks, and the tray switch locks are clamped to the tray connectors by means of third elastic elements.

9. The folding baby highchair according to claim 1, wherein chair leg switch locks are arranged on inner side of the chair legs and abut against the bottom of the cushion by means of fourth elastic elements, one end of each chair leg switch lock is clamped to the bottom of the cushion, two sides of each chair leg are hinged to the cushion by means of spindles, the chair legs can be folded towards the bottom of the cushion, and anti-slip pads are arranged at the bottoms of the chair legs.

10. The folding baby highchair according to claim 1, wherein a plurality of straps are connected to the backrest assembly and the cushion.

* * * * *